US009542780B1

(12) United States Patent
Watson

(10) Patent No.: US 9,542,780 B1
(45) Date of Patent: Jan. 10, 2017

(54) LOTTERY TICKET DISPENSER WITH SIDE-BY-SIDE ENGAGING MEMBERS

(71) Applicant: Owner Revolution Inc., Adair, IA (US)

(72) Inventor: Bruce Watson, Atlantic, IA (US)

(73) Assignee: OWNER REVOLUTION INC., Adair, IA (US)

( * ) Notice: Subject to any disclaimer, the term of this patent is extended or adjusted under 35 U.S.C. 154(b) by 0 days.

(21) Appl. No.: 14/817,506

(22) Filed: Aug. 4, 2015

(51) Int. Cl.
*A47B 87/00* (2006.01)
*G07B 7/00* (2006.01)
*G07B 3/00* (2006.01)

(52) U.S. Cl.
CPC ..... *G07B 7/00* (2013.01); *A47B 87/008* (2013.01); *G07B 3/00* (2013.01)

(58) Field of Classification Search
CPC ..... A47B 87/00; A47B 87/02; A47B 87/008; A47B 87/0276; A47B 87/0284; G07B 3/00; G07B 7/00
USPC ..... 312/107, 111, 34.1, 34.4, 34.7, 34.8; 206/39, 39.8, 509; 242/594, 594.6; 220/4.27
See application file for complete search history.

(56) References Cited

U.S. PATENT DOCUMENTS 2,950,946 A * 8/1960 Starworth ..... A47K 1/09 206/362.3
3,131,829 A * 5/1964 Masser ..... B65D 21/0204 206/144
3,401,993 A * 9/1968 Fenkel ..... A47B 87/02 206/509
3,552,817 A * 1/1971 Marcolongo ..... A47B 87/02 312/107
3,851,936 A * 12/1974 Muller ..... F16B 12/20 206/499
3,999,818 A * 12/1976 Schankler ..... A47B 87/02 312/107
4,328,902 A * 5/1982 North ..... B65D 21/0204 220/23.4
4,423,913 A * 1/1984 Lee ..... A47B 87/0276 211/194
4,643,494 A * 2/1987 Marleau ..... A45C 5/00 292/120
4,782,619 A * 11/1988 Richards ..... A01K 97/06 312/111
4,808,875 A * 2/1989 Edwards ..... A47B 88/0407 312/245
5,100,038 A * 3/1992 Schafer ..... A47K 10/426 225/32
5,287,980 A * 2/1994 Saltz ..... G07B 3/04 206/509
5,399,005 A * 3/1995 Schafer ..... G07B 3/04 206/509
5,743,605 A * 4/1998 Marino ..... G09F 15/00 221/58
6,050,657 A * 4/2000 Hiltzman ..... A47B 87/007 312/107
7,350,648 B2 * 4/2008 Gerstner ..... A47F 1/126 206/509

* cited by examiner

*Primary Examiner* — James O Hansen
(74) *Attorney, Agent, or Firm* — G. Brian Pingel; Camille L. Urban; David M. Breiner

(57) ABSTRACT

Disclosed is a display and dispensing lottery ticket dispenser designed to be attached in a side-by-side relationship with a similar type dispenser. More particularly, this invention relates to a lottery ticket dispenser that has side engagement members for attaching two dispensers together.

14 Claims, 6 Drawing Sheets

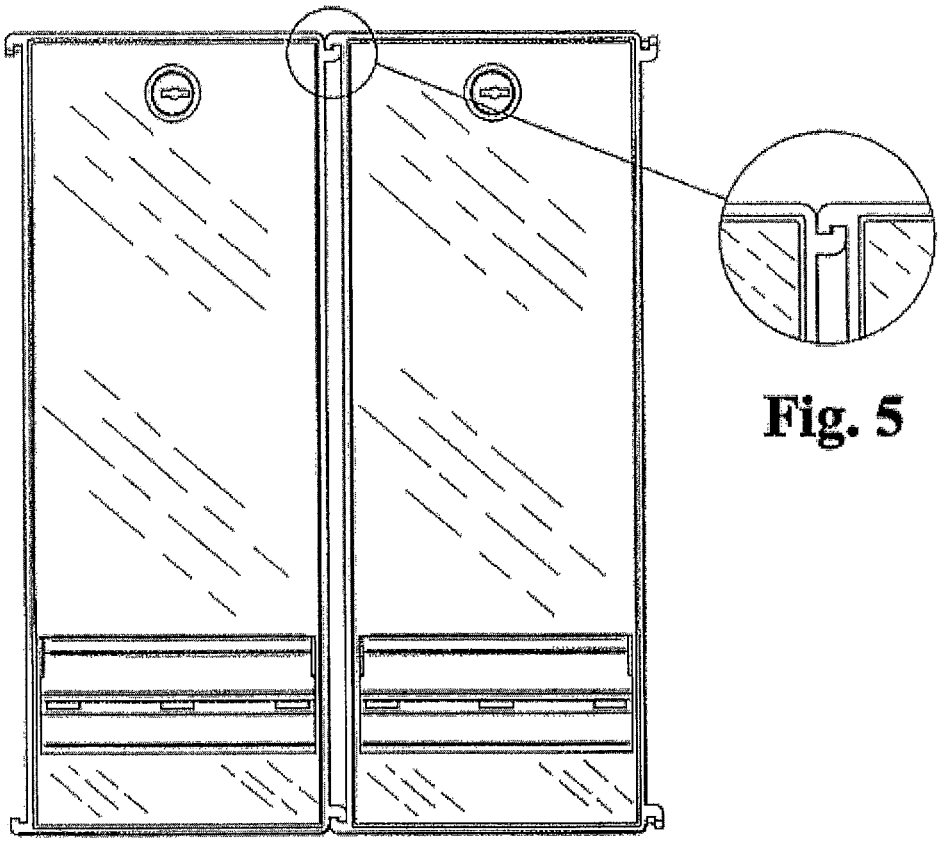
Fig. 5
Fig. 4
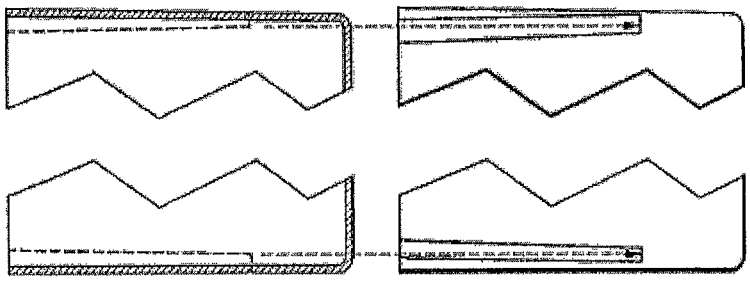
Fig. 6

LOTTERY TICKET DISPENSER WITH SIDE-BY-SIDE ENGAGING MEMBERS

BACKGROUND OF THE INVENTION

Field of the Invention

The present invention relates in general to a display and dispensing lottery ticket dispenser designed to be attached in a side-by-side relationship with a similar type dispenser. More particularly, this invention relates to a lottery ticket dispenser that has side engagement members for attaching two dispensers together.

Description of the Prior Art

The use of modular-like structures for displaying and dispensing lottery tickets has long been known in the art. Normally, when a number of such dispensers are located together at a point of sale location, they are arranged in a stacked arrangement with one dispenser being stacked on top of another in a locked relationship as disclosed in U.S. Pat. No. 5,399,005 issued to Schafer on Mar. 21, 1995.

The stacking and locking features of the Schafer invention have proven to be highly popular and successful in utilization with modular ticket dispensing structures to form a stacked arrangement, but such invention is not applicable for fastening such dispensers in a side-by-side relationship so that two adjacent stacks of dispensers can be affixed to one another. Accordingly, there has been a need in the industry for the provision of a means for attaching two ticket dispensers together in a side-by-side relationship.

One solution that has been developed for meeting the above attachment need is disclosed in U.S. Pat. No. 7,717,256 B1 issued to Jensen. The Jensen invention discloses the use of a coupling plate that is located between two adjacent dispensers for serving as a connecting structure for the adjacent dispensers. Although the Jensen invention provides a means for attaching two adjacent dispensers together in a side-by-side relationship, it is preferable for simplicity purposes to eliminate the engagement member disclosed in Jensen. Another type of engagement structure for forming a side-by-side relationship of two lottery ticket dispensers is disclosed in U.S. patent application. Ser. No. 14/345,359 filed in the name of Barrett et al. Disclosed in such application is the use of a lottery ticket dispenser that includes a pair of projecting nodes on one side of the dispenser that are meant to engage slots in the sidewall of an adjacent unit to attach the two dispensing units together in a side-by-side relationship. Although the Barrett et al. structure appears to disclose a means for attaching two adjacent dispensers together there still appears to be a need for an improved structure that provides a reliable and simplified means for serving as a connecting means between two adjacent dispensers.

SUMMARY OF THE INVENTION

The present invention may be embodied in a lottery ticket display and dispensing structure having a body with a first sidewall and a second sidewall, spaced apart upper and lower flanges on the exterior of the first sidewall with said upper flange forming a U-shaped upwardly facing channel and said lower flange forming a U-shaped downwardly facing channel, spaced apart upper and lower flanges on the exterior of the second sidewall, with said second upper flange forming a U-shaped downwardly facing channel and said lower flange forming a U-shaped upwardly facing channel.

The first and second spaced apart flanges may be designed to engage flanges on a second dispensing unit to connect said dispensing units together in a side-by-side relationship. To facilitate attachment of two dispensing units together in a side-by-side relationship, the upper and lower flanges may be directed on an incline with respect to one another.

The foregoing and other advantages of the present invention will appear from the following description. In the description, reference is made to the accompanying drawings, which form a part hereof, and in which there is shown by illustration and not of limitation a specific form in which the invention may be embodied. Such embodiment does not represent the full scope of the invention, but rather the invention may be employed in a variety of other embodiments and reference is made to claims herein for interpreting the breadth of the invention.

BRIEF DESCRIPTION OF THE DRAWINGS

FIG. 4 is a front view in elevation of two dispensing units shown engaged in a side-by-side relationship;

FIG. 5 is a close-up view of a portion of FIG. 4;

FIG. 6 is a view showing walls of a pair of flanges of one dispensing unit being inserted into channels of another pair of flanges of another dispensing unit.

DETAILED DESCRIPTION OF THE PREFERRED EMBODIMENT

Figure 1:
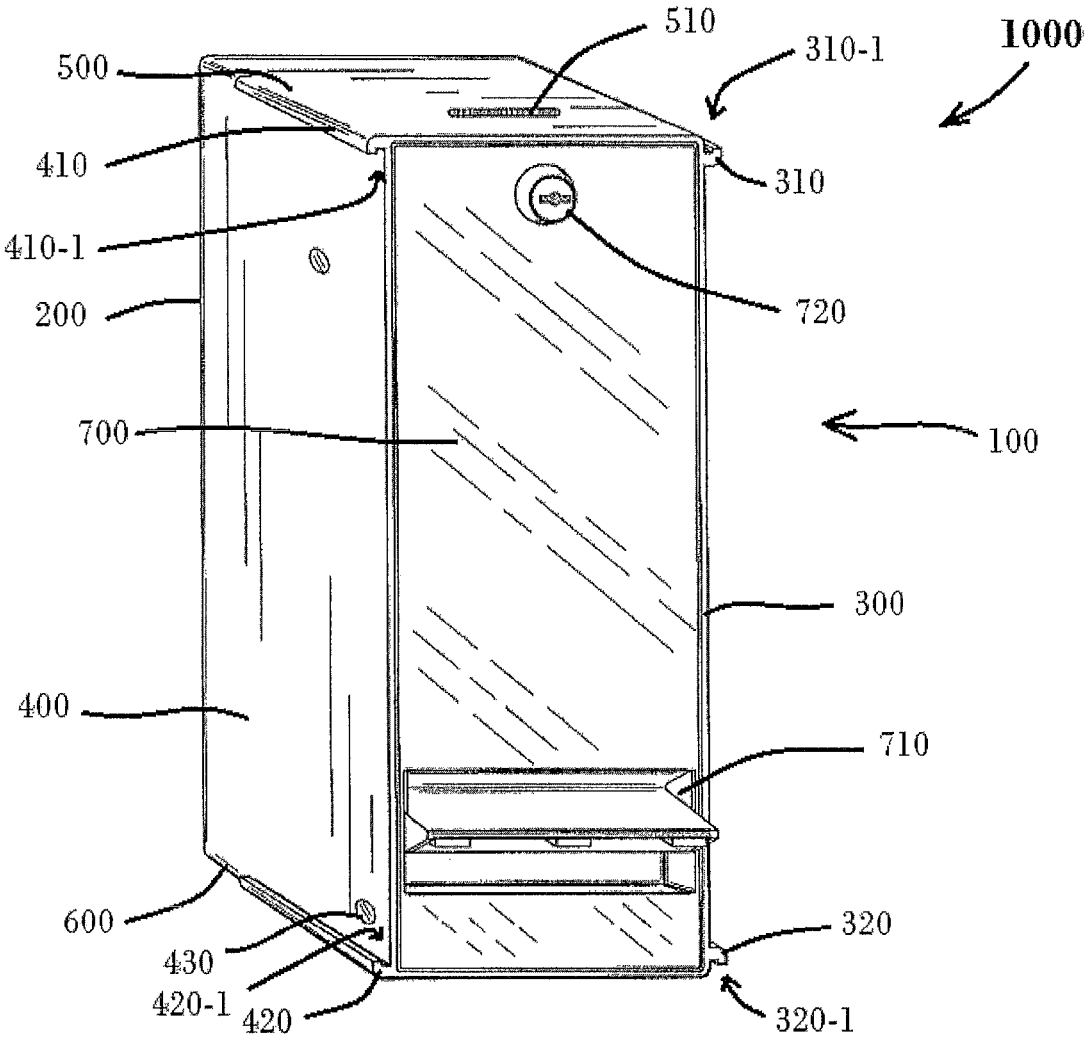
FIG. 1 is a side perspective view of an embodiment of a lottery ticket dispensing unit having a sidewall with upper and lower flanges.
Figure 2:
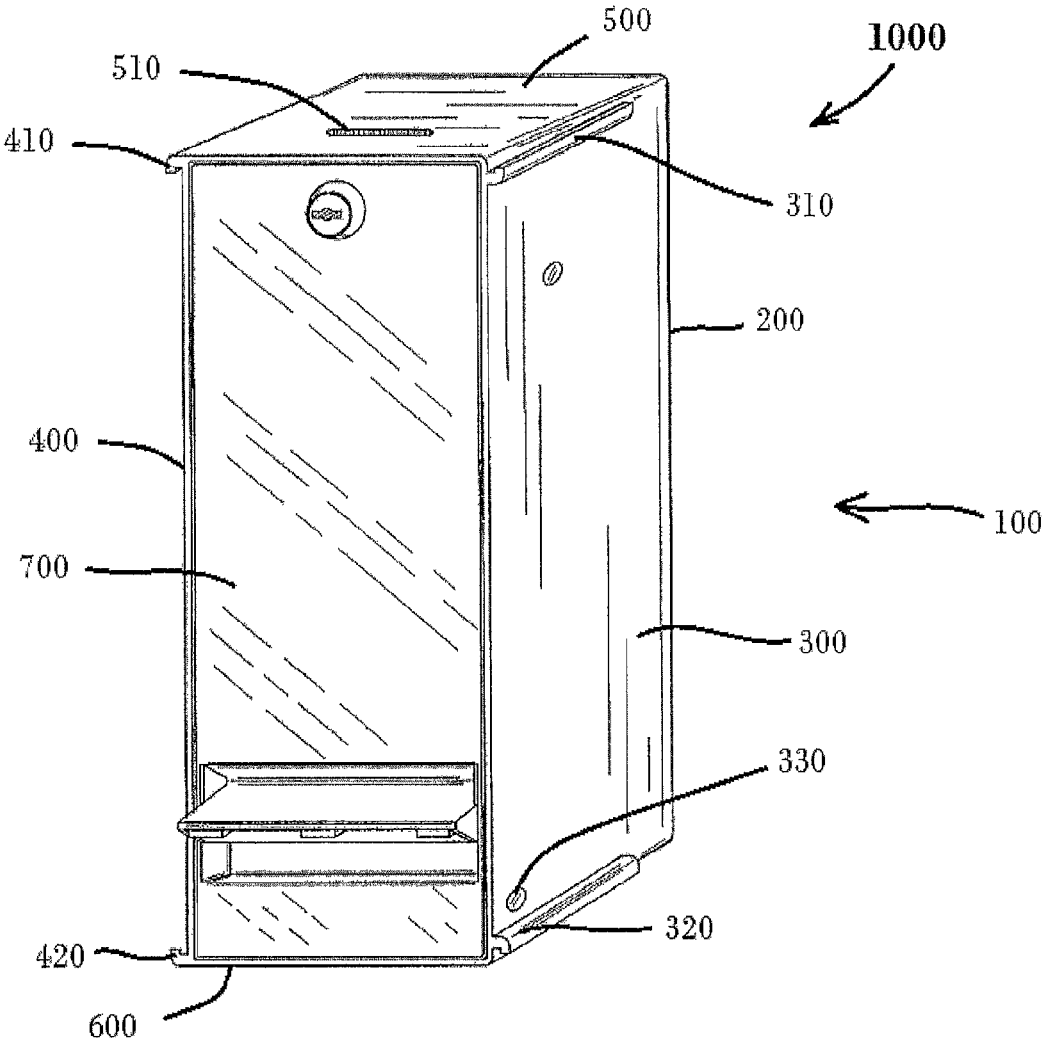
FIG. 2 is a side perspective view of the opposite side of the dispensing unit shown in FIG. 1 with said side having upper and lower flanges.

Example embodiments will now be described more fully with reference to the accompanying drawings. Example embodiments are not intended to limit the invention since the invention may be embodied in different forms. Rather, the example embodiments are provided so that this disclosure will be thorough and complete, and will fully convey the scope of the invention to those skilled in the art. In the drawings, the sizes of components may be exaggerated for clarity.

In this application, when an element is referred to as being "on," "attached to," "connected to," or "coupled to" another element, the element may be directly on, directly attached to, directly connected to, or directly coupled to the other element or may be on, attached to, connected to, or coupled to any intervening elements that may be present. However, when an element is referred to as being "directly on," "directly attached to," "directly connected to," or "directly coupled to" another element or layer, there are no intervening elements present. In this application, the term "and/or" includes any and all combinations of one or more of the associated listed items.

In this application, the terms first, second, etc. are used to describe various elements and components. However, these terms are only used to distinguish one element and/or component from another element and/or component. Thus, a first element or component, as discussed below, could be termed a second element or component.

In this application, terms, such as "beneath," "below," "lower," "above," "upper," are used to spatially describe one element or feature's relationship to another element or feature as illustrated in the figures. However, in this application, it is understood that the spatially relative terms are intended to encompass different orientations of the structure. For example, if the structure in the figures is turned over, elements described as "below" or "beneath" other elements would then be oriented "above" the other elements or features. Thus, the term "below" is meant to encompass both an orientation of above and below. The structure may be otherwise oriented (rotated 90 degrees or at other orientations) and the spatially relative descriptors used herein interpreted accordingly.

Example Embodiments are illustrated by way of ideal schematic views. However, example embodiments are not intended to be limited by the ideal schematic views since example embodiments may be modified in accordance with manufacturing technologies and/or tolerances.

The subject matter of example embodiments, as disclosed herein, is described with specificity to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other technologies. Generally, example embodiments relate to a lottery ticket dispenser.

FIG. 1 is a view of a lottery ticket dispensing unit 1000 in accordance with example embodiments. As shown in FIG. 1, the lottery ticket dispensing unit 1000 may resemble a box shaped container having a body 100. In example embodiments the body 100 may be comprised of a front wall 200, a first side wall 300, a second side wall 400, a roof 500, and a floor 600. In example embodiments the front wall 200, the first side wall 300, the second side wall 400, the roof 500, and the floor 600 may form a substantially open structure to receive lottery tickets, however, the invention herein is not limited thereto as the body 100 may be configured to receive other types of articles.

In example embodiments the front wall 200, the first side wall 300, the second side wall 400, the roof 500, and the floor 600 may be relatively thin elements in comparison to their lengths and widths. For example, the roof 200, when viewed from above, may resemble a plate having a width of about four inches, a length of about four and one half inches, and a thickness of about one tenth of an inch. In example embodiments, each of the first and second side walls 300 and 400 may have a height of about twelve inches, a depth of about four inches, and a thickness of about one tenth of an inch of an inch. The floor 500, for its part, when viewed from below, may resemble a plate having a width of about four inches, a length of about four and one half inches, and a thickness of about one tenth of an inch. The instant dimensions are for purposes of illustration only and are not meant to limit the invention since the dimensions of each of the front wall 200, the first side wall 300, the second side wall 400, the roof 500 and the floor 600 may deviate from the exemplary dimensions.

In example embodiments each of the front wall 200, the first side wall 300, the second side wall 400, the roof 500 and the floor 600 may be made from various types of materials. In one example, the body 100 is formed from a molding process in which plastic is used to form each of the front wall 200, the first side wall 300, the second side wall 400, the roof 500, and the floor 600. In this example, the body 100 is a substantially integral structure formed from a single process. In another embodiment, each of the front wall 200, the first side wall 300, the second side wall 400, the roof 500 and the floor 500 are made separately and then attached together via a conventional process such as welding (in the event the front wall 200, the first side wall 300, the second side wall 400, the roof 500, and the floor 600 are fabricated from a metal), gluing, screwing, pinning, etc.

In example embodiments the body 100 resembles an open box into which articles, such as lottery tickets, may be placed. In order to seal (or at least partially seal) the body 100 a door 700 is provided. The door 700 may be pin connected near a bottom of the first and second side walls 300 and 400. For example, in one nonlimiting embodiment, the first side 300 wall includes an aperture 330 (for example, a circular hole) in which a first protrusion (for example, a cylindrical type protrusion) from the door 700 may insert. Similarly, the second side wall 400 may include an aperture 430 (for example, a circular hole) through which a second protrusion (for example, a cylindrical type protrusion) from the door 700 may insert. With the first and second protrusions of the door 700 inserted into the apertures 330 and 430 of the first and second side walls 300 and 400 the door 700 is rotatably connected to the body 100.

In example embodiments the door 700 may further include a lock 720. In one embodiment, the lock 720 may include a flange that may be rotated into an aperture 510 of the roof 500. When the lock 720 is configured so that its flange is inserted into the aperture 510, the door 700 is locked in place to protect contents of the body 100. It is noted that the lock 720 illustrated in example embodiments is for the purpose of illustration only and the body 100 and the door 700 may be modified with a different locking system without departing from the inventive concepts provided herein.

In example embodiments, the door 700 may further include an aperture 710. The aperture may, but is not required to, resemble a slot. In example embodiments, the aperture 710 may allow an article, for example, a lottery ticket, to be drawn from the lottery ticket dispensing unit 1000.

In example embodiments the lottery ticket dispensing unit 1000 may include additional elements, for example, side engagement members, allowing it to connect to an adjacent lottery ticket dispensing unit, for example, in a side-by-side manner. For example, in one embodiment, the first sidewall 300 of the lottery ticket dispensing unit 1000 may include a first upper flange 310 and a first lower flange 320 spaced apart from one another as shown in at least FIG. 1. Similarly, the second sidewall 400 may include a pair of spaced apart flanges. For example, the second sidewall 400 may include a second upper flange 410 and a second lower flange 420 spaced apart from one another as shown in at least FIG. 1. As shown in example embodiments, each of the first and second upper flanges 310 and 410 may be proximate to the roof 500 and each of the first and second lower flanges 320 and 420 may be proximate to the floor 600.

In example embodiments, each of the upper flanges 310 and 410 and lower flanges 320 and 420 may have cross sections that resemble, but are not required to resemble, "L"-shaped flanges. Furthermore, as shown in at least FIG. 1, the first upper flange 310 may, with the first sidewall 300, form a "U"-shaped upwardly facing channel 310-1 and the second upper flange 410 may form a "U"-shaped downwardly facing channel 410-1. The first lower flange 320 may, with the first side wall 300, form a "U"-shaped downwardly facing channel 320-1 whereas the second lower flange 420, with the second side wall 400 form a "U"-shaped upwardly facing channel 420-1.

Figures 3A, 3B, 3C:
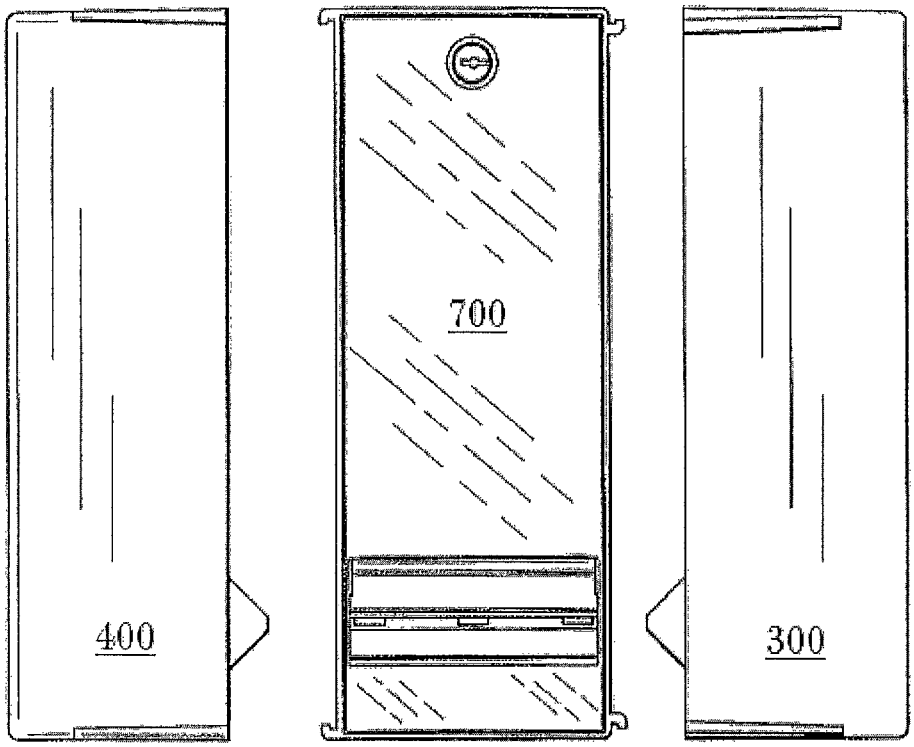
FIG. 3A is a side view in elevation of the dispensing unit.
FIG. 3B is a front view in elevation of the dispensing unit.
FIG. 3C is another side view in elevation of the dispensing unit.
Figure 3D:
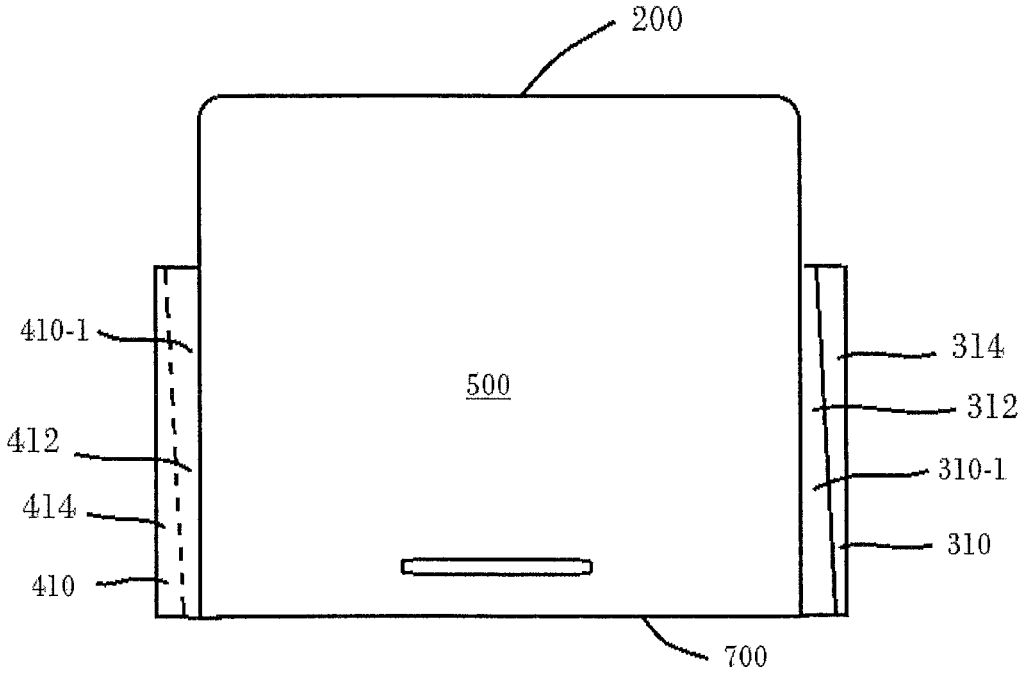
FIG. 3D is a top view of the dispensing unit.
Figure 3E:
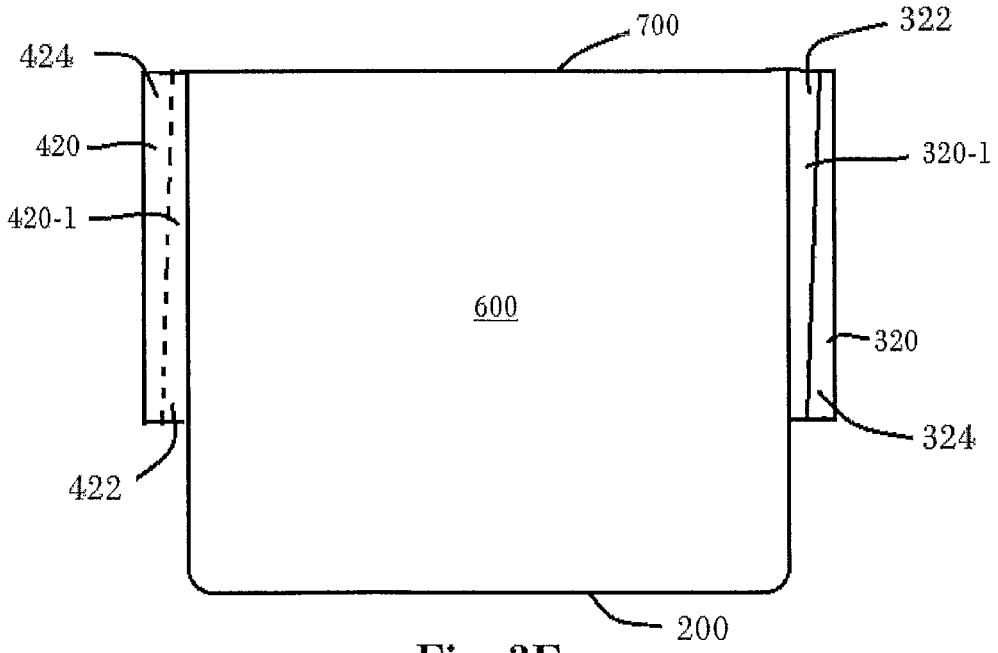
FIG. 3E is a bottom view of the dispensing unit.

FIG. 3D shows atop view of the roof 500 and FIG. 3E shows a bottom view of the floor 600. As shown in FIG. 3D, the channel 310-1 formed by the first upper flange 310 may have a width that varies along a length of the first upper flange 310. For example, as the first upper flange 310 extends towards the front wall 200 the width of the channel 310-1 may decrease, for example, linearly decrease. As for the channel 410-1 of the second upper flange 410, this channel 410-1 may also have a width that varies along a length of the second upper flange 410. For example, as the second upper flange 410 extends towards the front wall 200 the width of the channel 410-1 may increase, for example, linearly increase. In example embodiments, the channels 320-1 and 420-1 may also vary along a length of the first lower flange 320 and the second lower flange 420. For example, as the first lower flange 320 extends towards the front wall 200 the width of the channel 320-1 may decrease, for example, linearly decrease. As for the channel 420-1, the width of this channel may increase as the flange 420 extends towards the front wall 200, for example, this channel may linearly increase as the flange 420 extends toward the front wall 420

In example embodiments, the flanges 310, 320, 410, and 420 may be configured so that the channels 310-1, 320-2, 410-1, and 420-1 not only vary linearly in width, but are also inclined. For example, in one nonlimiting embodiment, the channels 310-1 and 410-1 may slope slightly upwards as the flanges 310 and 410 extend towards the front wall 200. The channels 320-1 and 420-1, however, may slope slightly downwards as the flanges 320 and 420 extend towards the front wall 200.

Figure 7:
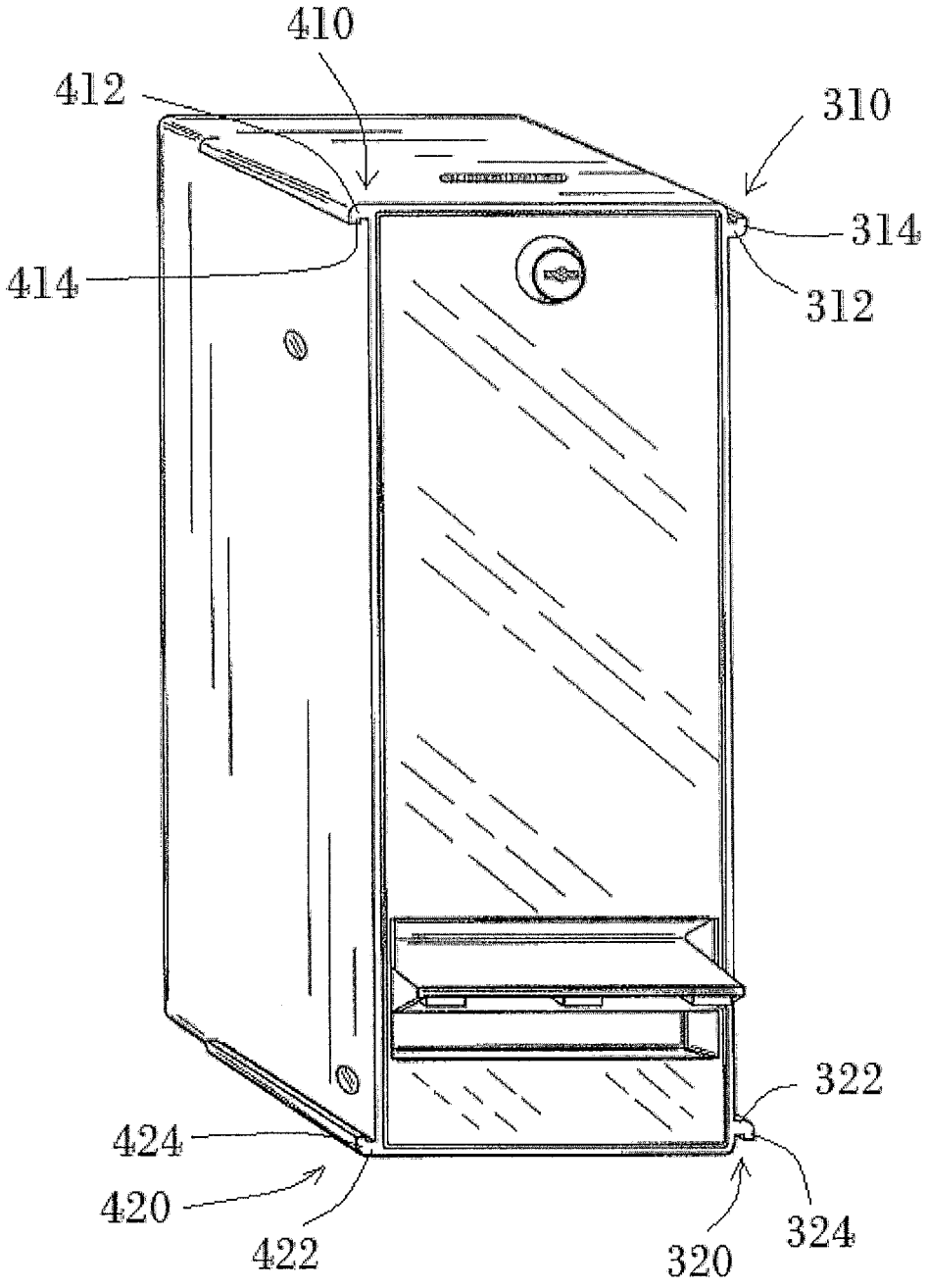
FIG. 7 is a view illustrating various portions of various flanges of a dispensing unit.

As alluded to earlier, flange 310 may have a cross-section that resembles an "L"-shape. For example, the flange 310 may be comprised of a base 312 and a wall 314 as shown in the various figures and emphasized in FIG. 7. The flange 310 together with the first side wall 300, form the channel 310-1. In example embodiments the flange 410 may also have a cross section that resembles an "L"-shape. Like flange 310, flange 420 may have a base 412 and a wall 414 which, together with the second side wall 400, form the channel 410-1. The flange 320 may also have a cross-section that resembles an shape. As with flanges 310 and 410, flange 320 may have a base 322 and a wall 324 which, together with the first side wall 300, form the channel 320-1. In example embodiments the flange 420 may also have a cross-section that resembles an "L"-shape. Like flanges 310, 320, and 410, the flange 420 may have a base 422 and a wall 424 which, together with the second side wall 400, form the channel 420-1. In example embodiments each of the walls 314, 324, 414, and 424 may be wedge shaped members which may allow each of the channels 310-1, 320-1, 410-1, and 420-2 to have a wedge shape.

In example embodiments the wall 314 may be configured to fit within the channel 410-1 of an identically formed lottery ticket dispensing unit 1000. Similarly, the second wall 324 may be configured to fit within the channel 420-1 of the identically formed lottery ticket dispensing unit 1000. This aspect of example embodiments may facilitate a second lottery ticket dispensing unit 1000 attaching to a first side of a first lottery ticket dispensing unit 1000. Similarly, in example embodiments, the wall 414 may be configured to fit within the channel 310-1 of an identically formed lottery ticket dispensing unit 1000. Similar yet, the second wall 424 may be configured to fit within the channel 320-1 of the identically formed lottery ticket dispensing unit 1000. This aspect of example embodiments may facilitate a second lottery ticket dispensing unit 1000 attaching to a second side of a first lottery ticket dispensing unit 1000.

FIG. 4 illustrates an example of one lottery ticket dispensing unit 1000 attached to an adjacent lottery ticket dispensing unit 1000. As shown in FIG. 4, the lottery ticket dispensing units 1000 may be connected to one another via the first upper, second upper, first lower, and second lower flanges 310, 410, 320, and 420 of the two lottery ticket dispensing units 1000. For example, as shown in FIG. 4, a portion of the second upper flange 420 (for example, wall 424) of the right side lottery ticket dispensing unit 1000 is inserted into the "U"-shaped upwardly facing channel 310-1 of the first upper flange 310 of the left side lottery ticket dispensing unit 1000. Also, as shown in FIG. 4, a portion of the second lower flange 420 (for example, wall 424) of the right side lottery ticket dispensing unit 100 is inserted into the "U"-shaped downwardly facing channel 320-1 of the first lower flange 320.

Example embodiments of the invention have been described in an illustrative manner. It is to be understood that the terminology that has been used is intended to be in the nature of words of description rather than of limitation. Many modifications and variations of example embodiments are possible in light of the above teachings. Therefore, within the scope of the appended claims, the present invention may be practiced otherwise than as specifically described.

What is claimed is:

1. A lottery ticket dispensing unit comprising:

(a) a body having a front wall, a first sidewall, a second sidewall, a floor, a roof and an opening opposite said front wall;

(b) a door pivotally attached to said body for closing said opening;

(c) spaced apart first upper and lower flanges on the exterior of said first sidewall, with said first upper flange forming a "U"-shaped upwardly facing channel and said first lower flange forming a "U"-shaped downwardly facing channel; and (d) spaced apart second upper and lower flanges on the exterior of said second sidewall, with said second upper flange forming a "U"-shaped downward facing channel and said second lower flange forming a "U"-shaped upwardly facing channel, wherein said first upper and lower flanges are "L"-shaped flanges having bases extending from the first side wall and wedge shaped walls extending from the bases, the wedge shaped walls having a varying thickness forming inclined surfaces which create an angle with the first sidewall so the U-shaped channels of the first upper and lower flanges have a varying width along a length of the first upper and lower flanges.

2. The lottery ticket dispensing unit of claim 1 wherein said first and second upper flanges are located proximate the roof of said body.

3. The lottery ticket dispensing unit of claim 1 wherein said first and second lower flanges are located proximate to the floor of said body.

4. The lottery ticket dispensing unit of claim 1 wherein said first and second upper and lower flanges are elongated and are directed on an incline.

5. The lottery ticket dispensing unit of claim 1 wherein said "L"-shaped first upper flange is directed on an incline front back to front.

6. The lottery ticket dispensing unit of claim 5 wherein said "L"-shaped first lower flange is directed on an incline from front to back.

7. The lottery ticket dispensing unit of claim 6 wherein said "L"-shaped second upper flange has a leg portion that is formed on an incline from back to front.

8. The lottery ticket dispensing unit of claim 7 wherein said "L"-shaped second, lower flange has a leg portion that is formed on an incline from front to back.

9. The lottery ticket dispensing unit of claim 8 wherein the inclined relationship between the first and second upper and lower flanges facilitates the engagement of said flanges with said flanges on said second dispensing unit.

10. The lottery ticket dispensing unit of claim 1, wherein a width of the "U"-shaped upwardly facing channel formed by the first upper flange varies linearly along a length of the first upper flange and a width of the "U"-shaped downwardly facing channel formed by the second upper flange varies linearly along a length of the second upper flange.

11. The lottery ticket dispensing unit of claim 10, wherein the width of the "U"-shaped upwardly facing channel formed by the first upper flange either increases and decreases as the first upper flange extends towards the front wall and the width of the "U"-shaped downwardly facing channel formed by the second upper flange is the other of the increases and decreases as the second upper flange extends towards the front wall.

12. The lottery ticket dispensing unit of claim 1, wherein the first upper and lower flanges extend towards the front wall from an end of the first sidewall distal from the front wall and the second upper and lower flanges extend towards the front wall from an end of the second sidewall distal from the front wall.

13. The lottery ticket dispensing unit of claim 1, wherein the first upper flange includes a wedge shaped wall having substantially the same dimensions as the downwardly facing "U"-shaped channel formed by the second upper flange.

14. A system comprising:

first and second lottery ticket dispensing units, each according to the lottery ticket dispensing unit of claim 1; wherein the first upper flange of the first lottery ticket dispensing unit is engaged with the second upper flange of the second lottery ticket dispensing unit and the first lower flange of the first lottery ticket dispensing unit is engaged with the second lower flange of the second lottery ticket dispensing unit so as to create a space between the first and second lottery ticket dispensing units.

* * * * *